United States Patent [19]

Manda et al.

[11] 4,113,572

[45] Sep. 12, 1978

[54] POLLUTION CONTROL SYSTEM INCLUDING A ONE-SPOT QUENCH-CAR FOR COKE PRODUCING INSTALLATIONS

[75] Inventors: John G. Manda, Florissant, Mo.; Joe D. Burroughs, O'Fallon, Ill.; Donald F. Cairns, Webster Groves, Mo.

[73] Assignee: National Steel Corporation, Pittsburgh, Pa.

[21] Appl. No.: 647,937

[22] Filed: Jan. 9, 1976

[51] Int. Cl.[2] ..... C10B 33/00; C10B 39/14; C10B 27/00

[52] U.S. Cl. ..... 202/227; 202/262; 202/263; 201/39; 214/17 C

[58] Field of Search ..... 202/227, 262, 263; 201/39, 41; 214/41 R, 17 C

[56] References Cited

U.S. PATENT DOCUMENTS

| | | | |
|---|---|---|---|
| 425,797 | 4/1890 | Hunt | 202/227 |
| 976,580 | 11/1910 | Krause | 202/227 |
| 1,006,281 | 10/1911 | Ries | 202/227 |
| 2,232,116 | 2/1941 | Koppers | 202/227 |
| 3,676,305 | 7/1972 | Cremer | 202/263 |
| 3,729,384 | 4/1973 | Kinzler et al. | 202/263 |
| 3,801,472 | 4/1974 | Kemmetmueller | 202/227 X |
| 3,812,018 | 5/1974 | Hinchliffe | 202/263 X |
| 3,843,461 | 10/1974 | Allen | 202/227 |
| 3,868,309 | 2/1975 | Sustarsic et al. | 202/263 X |
| 3,887,438 | 6/1975 | Kulakov et al. | 202/263 X |
| 3,897,313 | 7/1975 | Ibaragi et al. | 202/263 |
| 3,933,595 | 1/1976 | Gordon et al. | 202/263 X |
| 3,959,083 | 5/1976 | Goedde et al. | 202/227 X |
| 3,988,211 | 10/1976 | Lewandoski et al. | 201/39 X |

FOREIGN PATENT DOCUMENTS

| | | | |
|---|---|---|---|
| 201,551 | 4/1924 | United Kingdom | 202/227 |
| 212,514 | 8/1924 | United Kingdom | 202/227 |

*Primary Examiner*—Barry S. Richman
*Assistant Examiner*—Arnold Turk
*Attorney, Agent, or Firm*—Shanley, O'Neil & Baker

[57] ABSTRACT

A pollutant collection and removal system is provided for use with a horizontally arranged battery of coke ovens. A receptacle having a coke entry opening is positioned in front of the coke guide and receives the total coke pushed from an oven and a hood carried by the support for the coke guide substantially encloses the coke guide and overlies the coke entry opening and enshrouds the discharged coke and pollutants generated during the coke pushing operation. Means are provided for distributing the coke within the receptacle while said receptacle is being maintained stationary (i.e. one-spot) for quenching and, after the pushing operation, the receptacle is moved from the coke guide and transported to a quenching station. The receptacle is continuously subjected to a source of suction to move atmospheric air into and from the oven being pushed and into the hood and the receptacle and to continuously withdraw from the receptacle pollutants moved and discharged into the hood during the pushing operation and pollutants generated from the hot coke contained within the receptacle. The withdrawn pollutants are removed from the carrier air which is then discharged to the atmosphere. The system is readily adaptable for use with existing coking installations.

18 Claims, 9 Drawing Figures

FIG.8
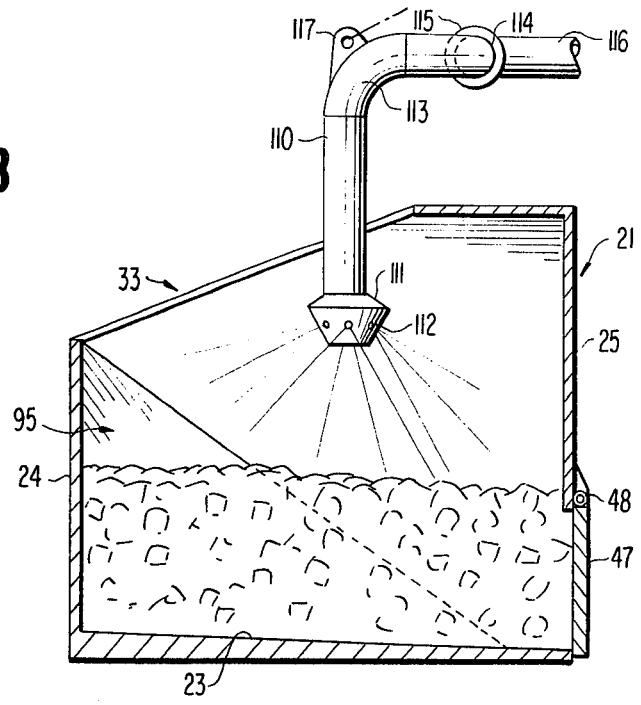
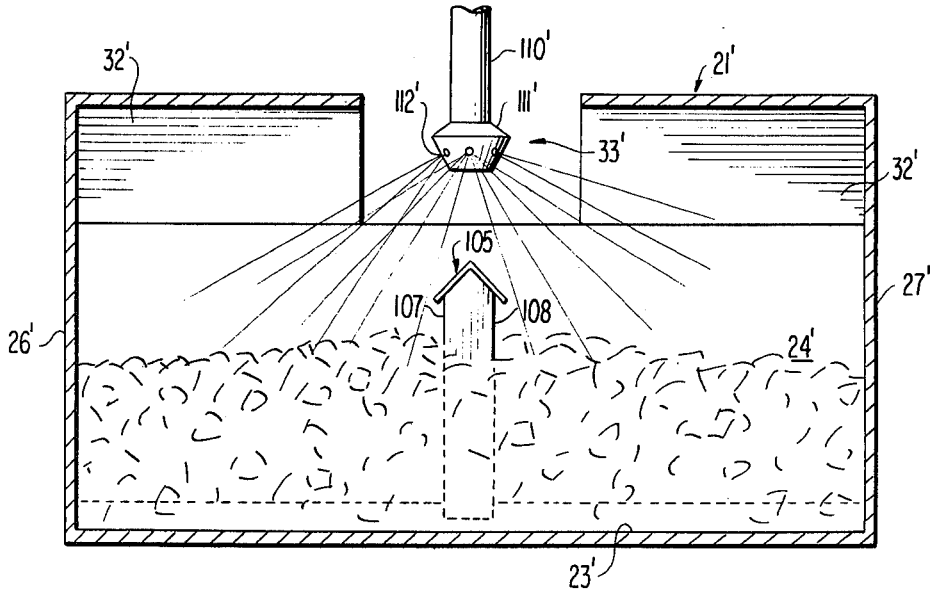
FIG.9

POLLUTION CONTROL SYSTEM INCLUDING A ONE-SPOT QUENCH-CAR FOR COKE PRODUCING INSTALLATIONS

BACKGROUND OF THE INVENTION

This invention relates to coke production. In particular, the invention relates to the prevention of environmental pollution during phases of coke production operations which present the most severe environmental problems.

In the production of coke from coal for use in making iron and steel, the coal is most often treated in a by-product coke oven. The process, including the equipment involved, is described in "The Making, Shaping and Treating of Steel", 9th Edition 1971, pages 109–164, published by U.S. Steel Corporation. In the process, at the end of the carbonization period, hot coke is pushed from one side of an oven and discharged at the other side of the oven into an open railway car. Large quantities of atmospheric pollutants, such as smoke and combustion fumes, are released in the general area of contact between the hot coke and air as the hot coke emerges from the oven and bursts into flame. The equipment traditionally used includes a battery of coke ovens and a coke guide mounted on a car which is moved on a track along the battery of ovens at their discharge side. The coke guide ordinarily includes vertical walls braced on the car with adequate clearance between them to permit passage of the cake of coke pushed from the oven, but sufficiently close together to aid in retaining the coherence of the cake of coke. The vertical walls are usually constructed of small channels that are separated by a given amount in order to effectively dissipate the heat and prevent warpage of the structure. When the doors at the pushing and discharge sides of a preselected oven are removed and the coke guide aligned with that oven, the coke is pushed from the oven and the cake of coke moves through the coke guide. Pollutants are immediately generated by the hot coke as it comes in contact with the air in the coke guide and enters the atmosphere through the open slots between the channel supports of the coke guide vertical walls. As the cake of coke extruded from the oven passes through and leaves the coke guide at its discharge end, the bottom and sides of the cake are no longer supported and the cake of coke crumbles in a fiery mass into the open railway car mounted on a track situated sufficiently below the coke guide and moving at a proper rate to catch the discharged coke. This results in the generation of additional pollutants, including fines, and pollutants are continuously generated from the hot coke in the railway car, which is exposed to the atmosphere, until the hot coke is quenched at some time thereafter.

Recently, the consideration of environmental quality has required that as much pollutants as possible should be kept from entering the atmosphere. Satisfaction of this requirement with respect to coke production installations has presented difficult problems, especially during the coke pushing operation and prior to quenching of the hot coke, due to the inherent characteristics of the coke production process, particularly the high temperatures involved, the massive size of the installation and the magnitude of pollutants generated. The problems are multiplied with respect to coke production installations already in existence which ordinarily include no provision for even attempting to control generated pollutants. In such installations, it has been difficult if not impossible to add necessary pollution control equipment to meet requirements without rebuilding basic structural components of the installation which cannot be done in many installations because of space limitations.

The present invention provides a novel method and apparatus for substantially completely solving all pollution problems attendant coke production beginning with and following the coke pushing operation where the most severe pollution problems are encountered. The method and apparatus provided by the present invention are so characterized as to be readily useable for effective pollution control in existing coke production installations without requiring structural changes in basic components of installation and without presenting space limitations.

BRIEF DESCRIPTION OF THE DRAWINGS

In the drawings, in which similar reference characters denote similar elements throughout the several views:

FIG. 8 is a diagrammatic view of apparatus employed at the quenching station for quenching coke contained in the receptacle; and FIG. 9 is a diagrammatic view of apparatus employed at the quenching station for quenching coke contained in a modified receptacle.

DETAILED DESCRIPTION OF THE INVENTION

Figure 1:
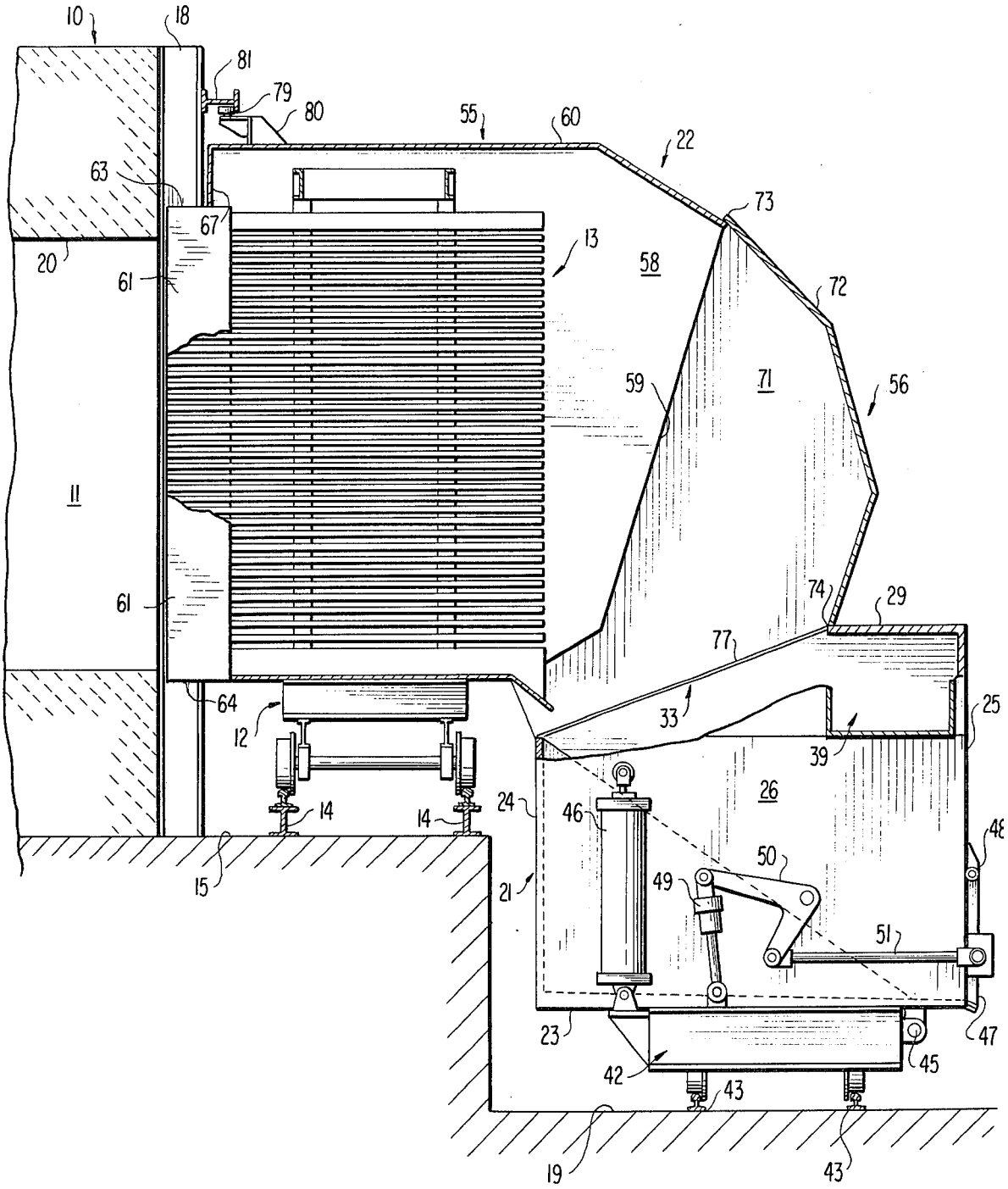
FIG. 1 is a diagrammatic showing, in side elevation and partly in section, of a coke producing installation embodying novel features provided by the present invention.
Figure 2:
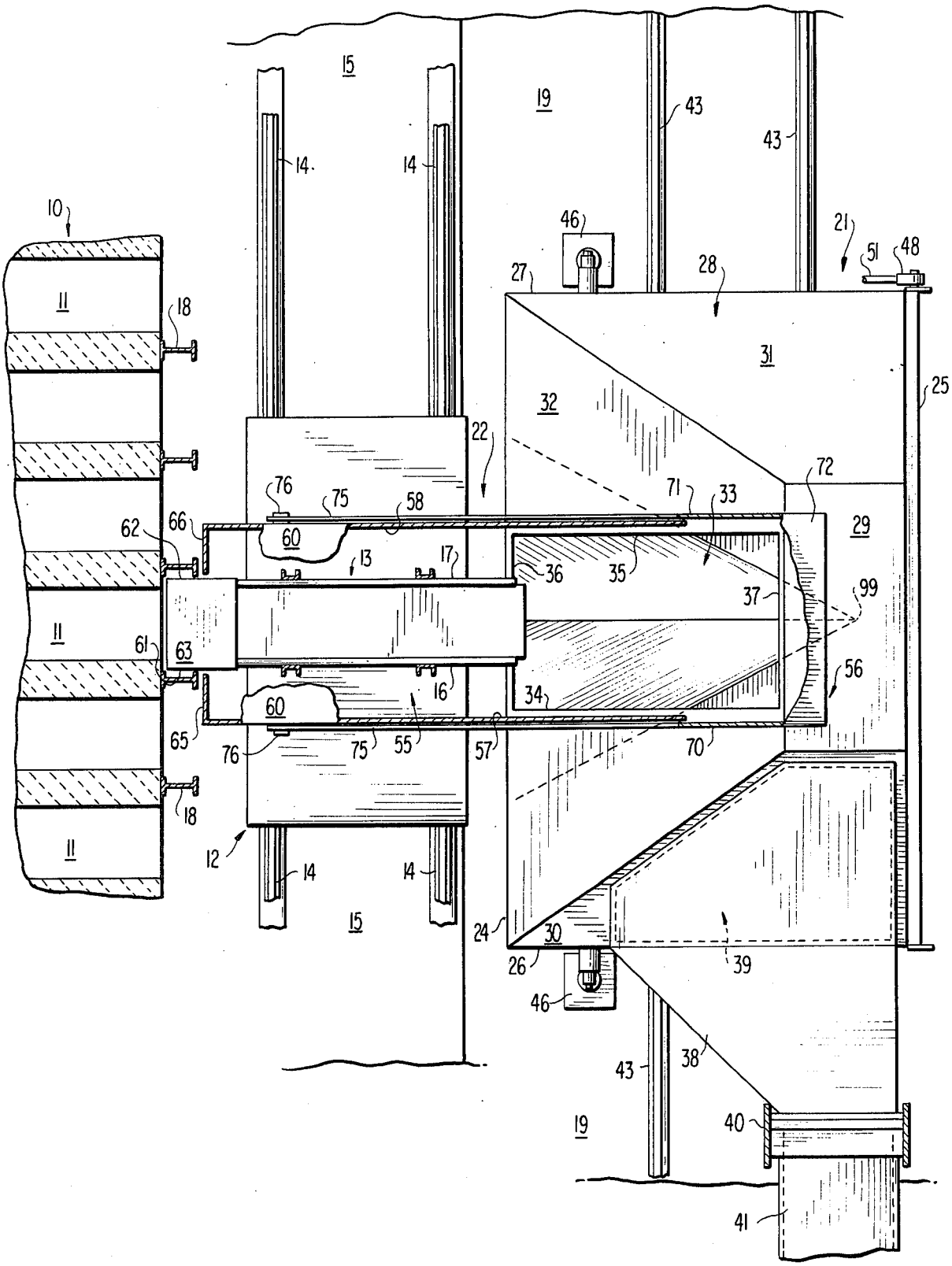
FIG. 2 is a top view, partly in section, of the installation shown in FIG. 1.
Figure 3:
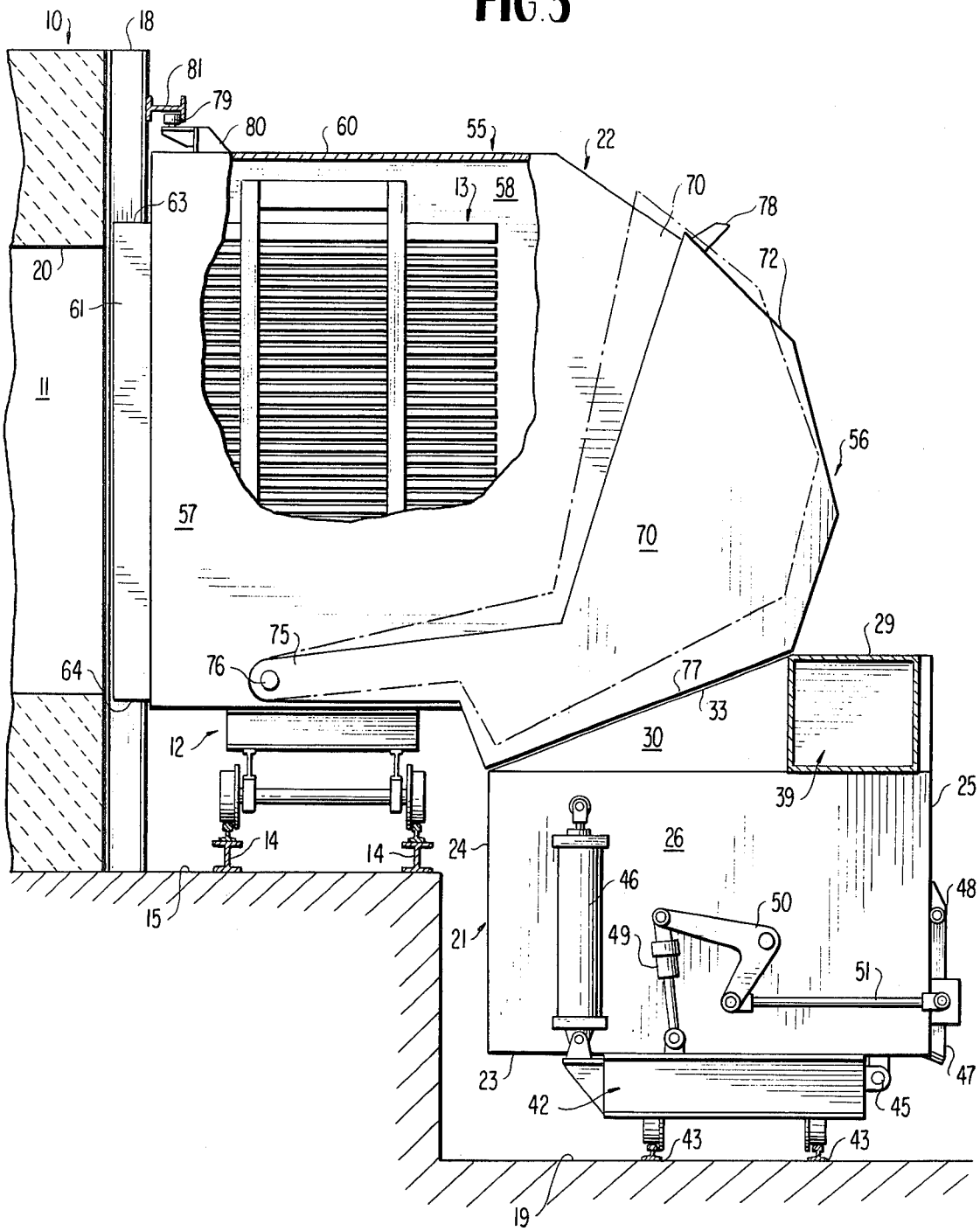
FIG. 3 is a diagrammatic showing similar to FIG. 1 with different components of the installation shown in section.

With reference to FIGS. 1, 2 and 3 of the drawings, a coke producing installation is shown including a battery 10 of coke ovens 11 and a car 12 supporting a coke guide 13. The car 12 is mounted on rails 14 bedded on floor 15 for movement along a path in front of the discharge openings of the coke ovens 11 to position the coke guide 13 in alignment with a selected coke oven from which coke is to be discharged by a pushing operation. The coke guide 13 includes parallel spaced vertically disposed slotted side walls 16 and 17, the side walls being spaced to receive therebetween a cake of coke pushed from the oven. One end of each side wall is located contiguous to the oven discharge opening between adjacent vertical bearing members 18 and the side walls extend outwardly therefrom and terminate beyond the floor 15 above a sub-floor 19. The above-described structures are conventional and details of the structures and of typical equipment used therewith, such as a machine for removing and replacing doors of the coke ovens, are not shown as their consideration is unnecessary for an understanding of the present invention. The operation is likewise conventional with the top of the cake of coke within the oven being spaced below the top wall 20 of the oven; such space being open to the atmosphere when the doors are removed and being in communcation with charging holes formed in the top of the oven which are usually open during the pushing operation.

Novel features provided by the present invention and embodied in the coke producing installation shown in FIGS. 1, 2 and 3 include a receptacle 21 for receiving and containing coke and a hood structure 22. The receptacle 21 is shown as a box-like structure of rectangular shape having a floor 23, side walls 24–25, end walls 26–27, and a top closure 28. The top closure 28 may include, as shown, a raised, horizontally disposed flat plate portion 29 located adjacent the side wall 25, plates 30 and 31 extending from ends of the plate 29 downwardly to the end walls 26 and 27, respectively, and a plate 32 extending downwardly from the plate 29 to the side wall 24.

A coke entry opening 33 is formed in the plate 30 of the top closure, the opening being defined by internal edges 34, 35, 36 and 37 of the plate 32. The opening 33 as shown is of rectangular shape with the side edges 34 and 35 disposed transversely of the length dimension of the receptacle. The space between the side edges 34 and 35 of the opening 33 is greater than the space between the sides 16 and 17 of the coke guide 13 and the side edges 34 and 35 are equally spaced from adjacent end walls 26 and 27, respectively, of the receptacle 21. Also, the side edges 36 and 37 of the opening extend from the wall 24 of the receptacle 21, located beneath the discharge end of the coke guide, in a direction toward the opposing wall 25 of the receptacle, through a major portion of the width dimension of the receptacle. The shape and size of the opening 33 is such that coke leaving the discharge end of the coke guide falls downwardly, through the opening 33, to within the receptacle. It will be appreciated that differently shaped openings in the top closure means of the receptacle could be used to meet this requirement.

The receptacle 21 includes a manifold 38 communicating with the interior of the receptacle in a region below the top closure means through an opening 39 formed in the plate 30. The manifold 38 terminates in a slip-connecting device 40 for establishing communication with a conduit 41 adapted to be connected to a source of suction. The receptacle 21 is mounted on a car 42 supported on rails 43 bedded on the sub-floor 19. The rails 43, parallel to the rails 14, provide movement of the receptable into operative relation with the coke guide 13 when the coke guide is positioned in alignment with any one of the coke ovens 11. When the receptacle is in operative position relative to the coke guide, as shown in FIG. 2, the coke entry opening 33 is centered relative to the discharge end of the coke guide with essentially equal portions of the opening 33 extending outwardly from planes passing through the side walls of the coke guide. As discussed below, the dimensions of the receptacle 21 are proportioned in accordance with the mass of coke pushed from any selected coke oven 11 so the receptacle may receive the total coke pushed from any oven and, in accordance with the process provided by the present invention, the receptacle remains stationary relative to the coke guide during the time the total coke pushed from any oven is discharged into the receptacle.

As discussed below, one of the features of the present invention is to effect quenching of the coke while contained in the receptacle 21. For this purpose, the receptacle is mounted on the car 42 for pivotal movement about a longitudinal axis adjacent one of its sides such as by a plurality of pivot means 45, FIG. 1. Fluid actuated cylinders 46 connected between the car and receptacle at opposite ends of the receptacle are provided for tilting the receptacle about the longitudinal axis. Also, the lower portion of the outer side wall 25 of the receptacle, throughout its length, includes door means 47, pivoted at 48, for outward and upward swinging movement to provide an opening through which the coke may be discharged from the receptacle. An arrangement including fluid actuated cylinder 49 connected to the car 42 and connected to the door means 47 by crank-arm 50 and rod 51, located at both ends of the receptacle, provides means for effecting opening and closing of the door means 47. If desired, the door means 47 may comprise two or more separate doors positioned in end-to-end relation along the length of the receptacle.

As shown more particularly in FIGS. 1, 2 and 3 of the drawings, the hood structure 22 is carried by the car 12 supporting the coke guide 13 and includes a fixed part 55 and a movable part 56. The fixed part 55 includes side walls 57 and 58 supported by the car 12 and spaced outwardly relative to sides 16 and 17, respectively, of the coke guide. The side walls 57 and 58 extend outwardly from adjacent the discharge openings of the oven 11 and each terminates at an edge 59 located beyond the discharge end of the coke guide. Also, the side walls 57 and 58 extend from below the bottom of the coke car upwardly to above the top of the coke guide and are joined by end closure 60. The side walls 57 and 58 are spaced so that the side walls lie outwardly of the edges 34 and 35 forming the coke entry opening 33 when the receptacle 21 is positioned in operative relation with the coke guide, that is, when the coke entry opening 33 is centrally positioned relative to the discharge end of the coke guide as shown in FIG. 2.

In accordance with the present invention, means are provided for establishing a sealing relation between the coke guide 13 at its coke entry end and adjacent structure of the fixed part 55 of the hood, when the coke guide 13 is located between adjacent vertical bearing members 18 in position to receive pushed coke, as illustrated in FIG. 2. As shown, the coke entry end of the coke guide 13 is provided with side plates 61 and 62 which overlie marginal portions of the sides 16 and 17 of the coke guide, respectively. The side plates 61 and 62 extend throughout the height of the coke guide, and are joined to top plate 63 and bottom plate 64 of the coke guide. This structure provides enclosure means that surrounds the sides and the top and bottom of the coke guide inwardly of the coke entry end of the coke guide. The fixed part of the hood is provided with means that cooperates with the coke guide enclosure means to obtain the sealing relation. As shown, the vertical edges of the side walls 57 and 58 of the hood, adjacent the oven, are joined to inwardly extending end walls 65 and 66, respectively, which terminate in sealing relation with the side plates 61 and 62, respectively, on the coke guide. Also, the edge of the end closure 60 of the hood, adjacent the oven, is joined to a downwardly depending end wall 67 which terminates in sealing relation with the top plate 63 on the coke guide. The plates 61 and 62 extend in a direction away from the discharge opening of the oven beyond the end walls 65, 66 and 67 when the coke guide is in coke receiving position. The spacing between plates 61, 62 and 63 and respective cooperating end walls 65, 66 and 67 is preferably as small as possible while permitting relative movement betweeen the coke guide and the hood under the existing temperature conditions.

The movable part 56 of the hood structure includes side portions 70 and 71 disposed outwardly of the fixed side walls 57 and 58, respectively, in partial overlapping relation, and extend beyond the edges 59 in a direction away from the discharge end of the coke guide, and terminate in edges joined to an end closure 72 extending between points 73 and 74. The side portions 70 and 71 are each provided with a rearwardly extending arm 75 in overlying relation with respective side walls 57 and 58 to which the arms are attached by pivot means 76 to permit swinging movement of the movable part 56 relative to the fixed part 55 of the hood structure. The lower edges of the side portions 70 and 71 terminate in linear portions 77 which extend from the point 74 in a direction toward the coke guide at an angle to contact surfaces of the plate 32 of the top closure 28 of the receptacle 21 adjacent the coke entry opening 33 when the movable part 56 of the hood structure is in closed position as illustrated in FIG. 3. In such position, the linear edge portions 77 extend throughout the length of the sides 34 and 35 of the coke entry opening 33 and the lower transverse edge of the end closure 72 in the region of the point 74 lies in contact with the surface of the plate 29 of the top closure 28 adjacent the end edge 37 of the coke entry opening 33. The movable part 56 of the hood structure may be swung upwardly about the pivot means 76, such as by means of a movable cable attached to hook 78, to position the movable part in open position, shown in broken lines in FIG. 3. As an aid in supporting the hood structure 22, a pair of rollers 79 are connected by brackets 80 to the end closure of the fixed part of the hood structure adjacent the ovens. The rollers are received in a raceway provided by flanged member 81 secured to the members 18 and extending throughout the battery of coke ovens.

The hood structure 22, when its movable part 56 is in the closed position and the receptacle 21 is in operable relation to the coke guide, and the sealing relation between the hood structure and the coke guide enclosure means, when the coke guide is positioned in close proximity with the discharge end of the oven for receiving pushed coke, as shown in FIG. 3 of the drawings, provides an enclosure that substantially completely encompasses the discharge opening of the selected oven, the coke guide 13 and the coke entry opening 33 of the receptacle 21. Such enclosure is subjected to suction when a source of suction is applied to the manifold 38 of the receptacle, and as a consequence of such suction, atmospheric air is drawn into the oven through the open pushing end of the oven and through the open charging holes in the roof of the oven and, together with gases and other pollutants generated within the oven, is drawn from the discharge opening of the oven into the enclosure. The effect of the suction within the enclosure also draws atmospheric air to within the enclosure through the space between the discharge end of the oven and the coke entry end of the coke guide. Likewise, suction within the enclosure will draw atmospheric air to within the enclosure through relatively movable parts of the structure that are in sealing relationship, that is: the end walls 65, 66 and 67 of the hood and the coke guide enclosure means; the edges of the hood and marginal portions of the plate 32 surrounding the coke entry opening 33 of the receptacle, and the region of overlap between the fixed and movable parts of the hood, none of which require a tight seal with practicing the principles of the present invention,.

Figure 4:
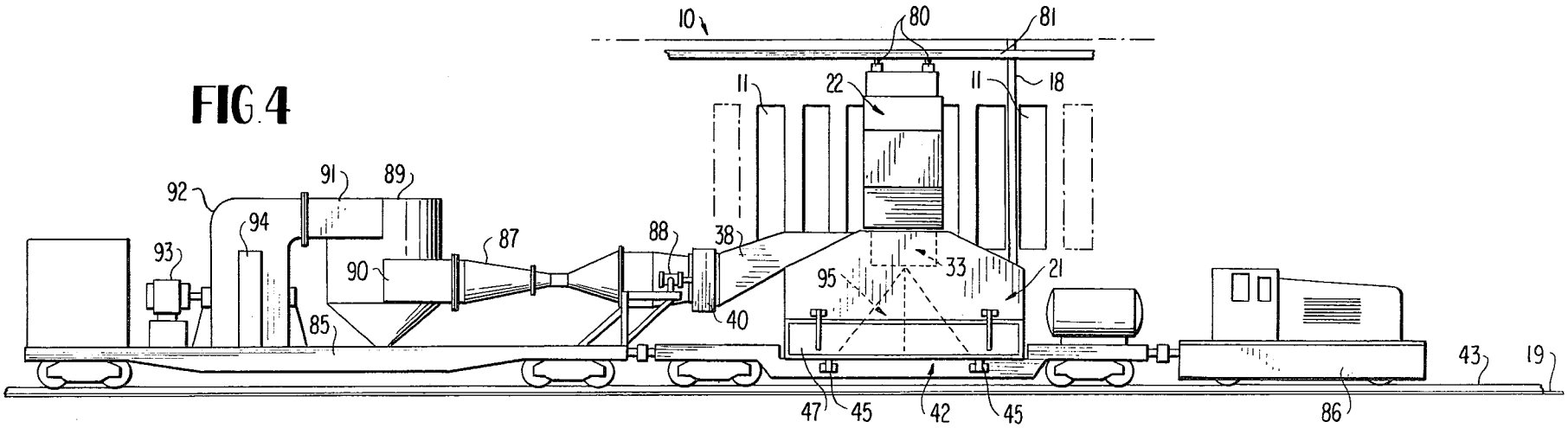
FIG. 4 is a diagrammatic view in front elevation of the coke production installation of FIG. 1 shown with gas cleaning equipment.

A front elevational view of the structure and apparatus described above is shown in FIG. 4 of the drawings together with gas cleaning equipment used in practicing the present invention. The gas cleaning equipment is mounted on a car 85 riding on the rails 43 and adapted to be coupled to the car 42 carrying the receptacle 21, the cars 42 and 85 being moved by an engine 86. The gas cleaning equipment includes a gas scrubber 87, the input of which is connected by the conduit 41 to the manifold 38 of the receptacle 21 through the slip-connecting device 40. Fluid actuated means 88 may be provided for making and breaking the slip connection as desired. The outlet of the gas scrubber 87 is connected to the input of a separator 89 by manifold 90 and the output of the separator communicates by conduit 91 to the suction side of a blower 92 driven by any suitable means such as an electric motor 93. With this arrangement, operation of the blower 92 subjects to suction the manifold 38 and pollutants that may be carried by atmospheric air drawn from the manifold 38 are removed by the action of the scrubber 87 and the separator 89 and pollutant-free atmospheric air is returned to the atmosphere through the discharge side 94 of the blower 92.

It is another object of the present invention to provide means for controlling the movement of coke discharged into the receptacle 21 through the coke entry opening 33 to substantially uniformly distribute the coke over the area of the floor 23 of the receptacle while the receptacle remains stationary relative to the coke guide 13. This feature of the invention obtains optimum quenching of the coke while contained by the receptacle with the use of relatively simple quenching equipment located at a quenching station.

Figure 5:
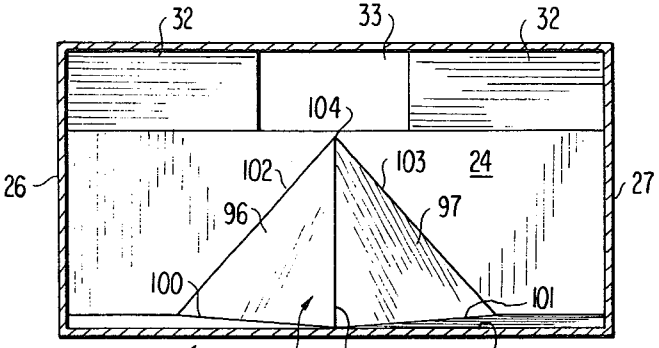
FIG. 5 is a diagrammatic view, partly in section, of the novel receptacle for receiving and containing coke provided by the present invention including means for leveling coke discharged into the receptacle.

One form of coke distribution means provided by the present invention is shown more particularly in FIGS. 2 and 5 in the form of a semi-pyramid structure 95 secured to the floor 23 and the back wall 24 of the receptacle 21. The structure 95 includes triangular sides 96 and 97 having adjacent edges joined along line 98 which terminates in a common vertex 99 in the plane of the floor. The other edges 100 and 101 of the triangular sides 96 and 97, respectively, lie in the plane of the floor 23 and the bases 102 and 103 of respective triangular sides lie in the plane of the back wall 24 with the bases intersecting the line 98 at point 104. The structure 95 is located in the receptacle in symmetrical relation with the coke entry opening 33 in the sense that a vertical plane passing through the line 98 bisects the width dimension of the coke entry opening 33. Also, when the receptacle 21 is in operative relation with the coke guide, a vertical plane passing through the line 98 is essentially parallel to, and equally distant from, the sides 16 and 17 of the coke guide.

With the arrangement shown in FIG. 5, coke entering the receptacle 21 through the coke entry opening 33 impinges upon the structure 95 and the coke is effectively divided with one part of the coke moving to the left of the line 98 and another part of the coke moving to the right of the line 98, all as viewed in FIG. 5. Also, impingement of the downwardly falling coke on the triangular sides 96 and 97 impart directions of movement of the coke toward the end walls 26 and 27 and also toward the front wall 25 of the receptacle to substantially uniformly distribute the total coke over the area of the floor 23. Factors considered in determining the configuration of the structure 95 include the floor area of the receptacle, the desired or the maximum permissible depth of coke for adequate quenching of the coke, the density of the hot coke and the angle of repose of the hot coke. Also, in accordance with the principles of the present invention, the area of the floor of the receptacle is dimensioned in accordance with the total mass of coke pushed from an oven, while considering the volume occupied by the structure 95 in the coke containing region of the receptacle, so that the receptacle may receive the total coke pushed from an oven of substantially uniform depth as may be desired for adequate quenching of the coke contained within the receptacle.

Figure 7:
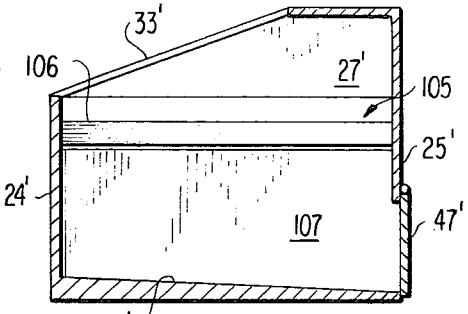
FIG. 7 is a diagrammatic view, in section, taken along the lines 7—7 of FIG. 6.
Figure 6:
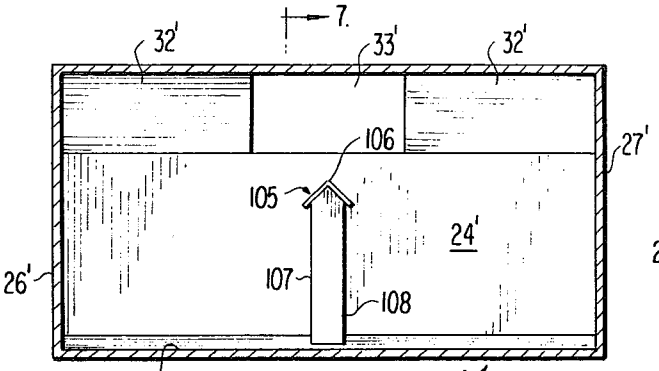
FIG. 6 is a diagrammatic view, partly in section, of the novel receptacle for receiving and containing coke provided by the present invention including another means for leveling coke discharged into the receptacle.

Another form of coke distribution means provided by the present invention is shown in FIGS. 6 and 7 of the drawings in combination with a receptacle similar to the receptacle 21, common elements being identified by primed reference numbers. As shown, an inverted V-shaped member 105 is supported in the receptacle 21' beneath the coke entry opening 33' with the apex 106 of the inverted V-shaped member lying in a vertical plane which bisects the width dimension of the coke entry opening 33'. The inverted V-shaped member 105 is horizontally disposed and extends from the rear wall 24' of the receptacle at least substantially throughout a projection of the coke entry opening 33' but preferably to the wall 25', as shown. The inverted V-shaped member 105 is supported by spaced vertically disposed plates 107 and 108 secured to the floor 23' and the walls 24' and 25' of the receptacle. In operation of this embodiment, coke discharged into the receptacle through the coke entry opening 33' impinges upon the inverted V-shaped member 105 and the coke is essentially divided with one part being caused to move to the left of the inverted V-shaped member and another part moving to the right of the inverted V-shaped member, as viewed in FIG. 6. The momentum and direction of the downwardly falling coke upon striking the inverted V-shaped member 105, on both sides of the elongated apex 106, causes the coke to move in directions toward the end walls and the front wall 25' of the receptacle to substantially uniformly distribute the coke over the floor of the receptacle. The height of the inverted V-shaped member 105 above the floor of the receptacle and the width dimension of the portions forming the V-shaped member, as well as the dimensions of the receptacle relative to the total mass of coke pushed from an oven, are determined in accordance with the considerations discussed above relative to the embodiment including the semi-pyramid structure 95.

As mentioned above, it is a feature of the present invention to effect quenching of the coke when contained in the receptacle 21. The quenching operation may be performed at a quenching station remote from the position of the receptacle during a coke pushing operation. With the exception of means for introducing quenching water to within the receptacle described below, the quenching station may be of conventional construction including gas cleaning equipment independent of the gas cleaning equipment carried by car 85, and details of the quenching station need not be shown for an understanding of the principles of the present invention. Arrangements for introducing water into the receptacle for quenching the coke are shown in FIGS. 8 and 9. The embodiment of FIG. 8, shown with a receptacle including a semi-pyramid structure 95 for effecting uniform distribution of the coke within the receptacle, includes a vertically disposed conduit 110 having a lower end 111, as viewed in the drawing, provided with a multiplicity of nozzles 112. The upper end of the conduit 110 is connected to a 90° elbow 113 which is connected to a transverse conduit portion 114 rotatably supported by a stationary bearing 115. Water under pressure is supplied by conduit 116 communicating with the portion 114 on the other side of the bearing 115 in axial relation with the bearing 115. A tab 117 connected to the elbow 113 provides means for controllably swinging the conduit 110 about the axis of the bearing 115. The apparatus is shown in quenching position with the conduit 110 extending through the coke entry opening 33 and the nozzled end located within and essentially centrally of the receptacle. A suitable number of properly designed nozzles 112 are provided to effect substantially uniform spray of water over the entire area of the coke retained within the receptacle. When the quenching operation is completed, a force is applied to the tab 117 to swing the conduit 110 in a clockwise direction about the axis of bearing 115 to move the nozzled end 111 through the coke entry opening 33 to without the receptacle to permit discharge of quenched coke from the receptacle and subsequent removal of the receptacle from the quenching station. When a receptacle containing unquenched coke is positioned at the quenching station, the conduit 110 is rotated in a counterclockwise direction to move the nozzled end 111 through the coke entry opening 33 to the quenching position shown in the drawing. In FIG. 9, the quenching apparatus is shown with a receptacle provided with an inverted V-shaped coke distribution means. The nozzled end 111' is moved into and out of the receptacle through the coke entry opening 33' in the manner described above in connection with FIG. 8. The apparatus is shown in quenching position with the nozzled end 111' located within the receptacle, essentially centrally of the receptacle floor and above the inverted V-shaped member 105.

Operation of the apparatus provided by the present invention is described below together with the manner of practicing the novel process herein disclosed for obtaining an essentially pollution free coke producing operation during the phase of coke pushing and prior to quenching of the coke.

When an oven is selected to be pushed, the doors of the selected oven are removed, the car 12 is moved to align the coke guide 13 with the selected oven and the coke guide is moved toward the oven to its coke receiving position, the hood structure 22 moving with the car 12. As soon as possible thereafter, the car 42 is moved to align in operative relation the coke entry opening 33 of the receptacle 21 with the coke guide 13, as shown in FIG. 2, and the movable part 56 of the hood structure 22 is moved to closed position, as shown by the full lines in FIG. 3, to encompass the coke entry opening. The car 85 is coupled to the car 42 and the cars are moved as a unit by the engine 86. The manifold 38 is connected to the conduit 41 by the slip-connecting device 40 and the blower 92 is operating to subject the manifold 38 to suction. Thereupon, the interior of the receptacle 21 and the enclosure defined by the hood structure 22 are subjected to suction through the manifold 38 to cause atmospheric air to flow into and through the selected oven and into the enclosure defined by the hood structure through the shrouded entry end of the coke guide, and hence from the enclosure through the receptacle, the manifold 38 and the gas cleaning equipment including the scrubber 87 and the separator 89 before being discharged to the atmosphere through the discharge 94 of the blower 92. The suction applied to the manifold 38 also causes atmospheric air to enter into the shrouded entry end of the coke guide through the space between the discharge opening of the oven and the coke guide to prevent the escape to the atmosphere of pollutants through such space. Also, the suction within the receptacle and the enclosure of the hood structure moves atmospheric air through seals provided between relatively movable surfaces to within the enclosure and the receptacle to preclude escape of pollutants directly to the atmosphere. Thus, prior to the beginning of the coke pushing operation, smoke and fumes generated within the oven are moved with the inflowing atmospheric air to within the enclosure defined by the hood structure and such pollutants are withdrawn from the hood enclosure and passed through the gas cleaning equipment where the pollutants are removed before the air is discharged from the blower 92. It is desirable to effect the foregoing operation as quickly as possible after the oven doors are removed.

The operation described above is continued throughout the coke pushing operation to insure that pollutants generated during the pushing operation and generated from pushed coke are removed by the gas cleaning equipment and not discharged directly to the atmosphere. In particular, when the cake of coke is pushed from the oven, pollutants that are immediately generated when the hot coke comes in contact with the atmosphere are retained within the enclosure of the hood structure due to the continuous inward flow thereto of atmospheric air and such pollutants are conducted with the carrier air to the gas cleaning equipment where the pollutants are removed prior to discharge of the air to the atmosphere. As the cake of coke is pushed through the coke guide, additional pollutants are generated and, when the cake of coke loses its support provided by the coke guide, it breaks into particles causing further generation of pollutants including fines. All such pollutants are retained within the enclosure of the hood structure and in the manner described above are sucked through the interior of the receptacle, its manifold 38 and the gas cleaning equipment, the scrubber 87 and the separator 89, where the pollutants are removed and pollutant-free air is discharged from the discharge of the blower 92. As the coke pushing operation proceeds, fiery masses of coke fall through the coke inlet opening 33 into the interior of the receptacle 21 resulting in generation of pollutants and pollutants are also generated from the hot coke within the receptacle. Such pollutants, due to the suction established by the blower 92, are withdrawn with the carrier air through the manifold 38 and passed to the gas cleaning equipment where the pollutants are removed in the manner described above.

In accordance with the principles of the present invention, the capacity of the blower 92 is such as to establish a magnitude of suction within the rectacle 21 and within the enclosure of the hood structure 22 to establish and continuously maintain flow of atmospheric air through the oven being pushed and into the enclosure defined by the hood structure, as well as the flow of atmospheric air into the enclosure through the space between the discharge opening of the oven and the entry end of the coke guide and the inward flow of atmospheric air through the seals provided between relatively movable surfaces of the structure. The required magnitude of suction is maintained throughout the pollution control operation including certain phases of the coke pushing operation when large quantities of pollutants are generated that tend to increase the pressure within the enclosure. Also, the gas cleaning equipment is provided with a capacity to effectively remove pollutants from the air at rates of flow required for the magnitude of suction maintained.

In order to meet these requirements, the equipment carried by the car 85 may include more than one blower, more than one gas scrubber and more than one separator.

The feature of the present invention of subjecting the enclosure defined by the hood structure and of the interior of the receptacle to a magnitude of suction to maintain at all times during the operation the inflow of atmospheric air to within the enclosure and the receptacle, not only prevents the escape of pollutants to the atmosphere except after passing through the gas cleaning equipment but simplifies construction of the hood structure and its relation to the coke oven being pushed, its relation to the coke guide and its relation to the receptacle. In particular, the hood structure 22 need not be constructed to provide gas-tight seals with the discharge end of the coke oven, the coke guide or the coke entry opening of the receptacle, and the hood structure itself may be constructed of relatively movable parts, as disclosed, without requiring gas-tight seals. Nor are auxiliary sealing means, such as jets of air, required to minimize outward flow of pollutants when practicing the present invention.

After the coke pushing operation is completed and the total coke from the selected oven has been discharged into the receptacle 21 and all pollutants generated during the pushing operation have been scavenged from the enclosure defined by the hood structure 22, the movable part 56 of the hood structure is moved to its open position to permit movement of the receptacle 22 and its transport on the rails 41 to a quenching station located remove from the pushing operation; however, operation of the blower 92 is not terminated and application of suction to the manifold 38 of the receptacle 21 continues uninterrupted. Thus, when the hood structure is moved to open position and the coke entry opening 33 is moved away from the overlying encompassing portion of the hood, atmospheric air is drawn into the receptacle through the coke entry opening 33 to prevent the escape of pollutants through that opening; such pollutants which are continually generated from the hot, fiery coke within the receptacle are withdrawn from the receptacle through the discharge manifold 38 and passed through the gas cleaning equipment where the pollutants are removed for deliverying pollutant-free air to the atmosphere. The car 85 carrying the gas cleaning equipment moves with the car 42 while transporting the receptacle 21 containing hot coke to the quenching station, the connection between the manifold 38 and the conduit 41 is maintained and the blower 92 is continually operated to maintain a magnitude of suction as required to prevent the escape of pollutants through the coke entry opening 33 and effectively collect the pollutants in the manner described above until the receptacle 21 reaches the quenching station which is provided with separate hood means amd gas cleaning equipment. At that time, operation of the blower 92 is terminated.

At the quenching station, the water spray apparatus, such as shown in FIGS. 8 and 9 of the drawings, is moved into the receptacle through the coke entry opening 33 and water is discharged from the nozzles to uniformly spray with water the coke distributed over the area of the floor of the receptacle. Water that may reach the floor of the receptacle is permitted to drain from the receptacle. For this purpose, the floor 23 of the receptacle is slightly inclined in a direction toward the longitudinal door means 47, FIG. 1, so that water reaching the floor flows outwardly from the receptacle beneath the door means. When the quenching operation is completed, the water spray apparatus is rotated upwardly to outside the receptacle, and with the slip-connecting device disconnected, the cylinders 46 are actuated to rotate the receptacle in a clockwise direction about the longitudinal axis of the pivot means 45 to incline the floor 23 in a direction toward the door means 47 and, upon energization of the cylinders 49, the door means 47 is moved to open position to effect discharge of the quenched coke from the receptacle 21 onto a coke wharf or a conveyor system for transporting the coke product from the installation.

As discussed above, when the cake of coke pushed from the oven breaks up upon leaving the discharge end of the coke guide 13, pieces of coke fall downwardly through the coke entry opening 33 into the interior of the receptacle 21 and the coke distribution means located beneath the coke entry opening 33, such as the means shown in FIGS. 5 or 6, functions to substantially uniformly distribute the coke over the entire area of the floor of the receptacle, and the useable area of the floor for containing coke is dimensioned relative to the total mass of coke pushed from the selected oven so that the coke contained within the receptacle is at a depth for optimum quenching during the ensuing quenching operation at the quenching station. These features of the invention make possible the obtaining of high quality coke by following simple quenching procedures and makes unnecessary the use of complicated water spraying equipment.

The present invention thus provides a novel apparatus and process for effectively controlling the generation of pollutants during operation of coking installations, particularly during the phase of the coking operation beginning with the pushing of coke from a selected oven and extending to the quenching of such coke. The invention provides a novel receptacle and a novel hood structure which coacts with the receptacle and the coke guide to achieve the foregoing results. The receptacle receives the total coke pushed from a selected oven while stationary with respect to the coke guide. The receptacle is closed but for an opening in its top through which the receptacle receives coke discharged from the coke guide and a manifold which communicates through gas cleaning equipment to the suction side of a blower, and the receptacle is provided with means for uniformly distributing the coke over the area of the floor of the receptacle. The hood structure provided is in sealing relation with the entry end of the coke guide, and overlies the sides, the top and the discharge end of the coke guide as well as the coke entry opening of the receptacle, to establish the inward flow of atmospheric air to within the enclosure defined by the hood, particularly through the oven being pushed, uder the influence of suction of the blower to preclude the flow directly to the atmosphere of pollutants generated during the pushing of the coke and to restrict the flow of such pollutants through the manifold of the receptacle and through the gas cleaning equipment where the pollutants are removed so that air discharged to the atmosphere is essentially free of pollutants. After the pushing operation, the receptacle containing the hot coke is moved to a quenching station provided with independent gas cleaning equipment. During transport of the receptacle to the quenching station, the blower and the gas cleaning equipment move therewith. Throughout the transport, the blower continuously operates to move atmospheric air into the receptacle through the coke entry opening and prevent outward flow, directly to the atmosphere, of pollutants generated from the hot coke within the receptacle and to move such pollutants through the gas cleaning equipment. The feature of uniformly distributing coke over the area of the floor of the receptacle and of controlling the depth of the coke within the receptacle makes possible the obtaining of high quality coke by quenching the coke when contained in the receptacle without requiring the use of complex quenching equipment.

The novel means and process provided by the present invention have special applicability to existing coke producing installations and the features of the present invention may be utilized in such installations without limitation with respect to space requirements and without requiring rebuilding of basic components of the installation. In this regard, it will be appreciated that the car 12 running on rails bedded on the floor 15 and the coke guide itself may be parts of an existing installation. Coke guide cars used in existing installations may adequately support the hood structure 20 according to the present invention if provided with means acting between the hood structure and the coke oven battery to resist turning moments resulting from the portion of the hood structure projecting beyond the discharge end of the coke guide. It will be further appreciated that the sub-floor 19 located below and extending outwardly from the discharge end of the coke guide may also comprise structure of an existing installation as well as the rails 43 bedded on the sub-floor 19 which, in an existing installation, support the conventional open railway car into which coke is discharged from the coke guide. When applying the principles of the present invention to such an existing installation, the receptacle for receiving and containing coke may be mounted on a car for movement on the rails 43 and the receptacle may be dimensioned so that its coke entry opening is located below and inwardly of the discharge end of the coke guide. Accordingly, an existing coke producing installation may be reconstructed to embody the novel means and practice the novel process provided by the present invention by slightly modifying the existing coke guide, byu providing the novel hood structure to be supported by the existing car carrying the coke guide and by replacing moving components of the existing installation with structure provided by the present invention such as the novel receptacle for receiving and containing the coke.

Although one embodiment of the invention has been illustrated and described in detail above, it will be appreciated that various changes and modifications may be made in the novel apparatus and process specifically illustrated and described, in addition to the modifications mentioned above, without departing from the spirit of the invention. For example, the receptacle for receiving and containing the coke need not be of rectangular shape as illustrated in the drawings but may under certain circumstances be of essentially square, or non-rectangular or cylindrical or semi-cylindrical configuration; a unitary hood pivotally supported by the gas carrying the coke guide may be employed, and different gas cleaning equipment may be used.

We claim:

1. For use in combination with a coking installation including a horizontally arranged battery of coke ovens and a coke guide mounted on a guide car for movement along a path in front of the battery and into a pushing position in alignment with the respective coke ovens for guiding coke pushed therefrom to a hot coke transfer car movable on rails parallel to the path of the guide car and outwardly spaced therefrom, with the transfer car being positioned in alignment with the oven and guide car during the pushing operation and movable along the rails to a quenching station spaced from the ovens, an improved one-spot hot coke transfer and quenching car comprising, a generally rectangular receptacle for receiving and containing a full charge of hot coke from a coke oven, said receptacle having a flat, generally horizontal bottom wall, upwardly extending side walls and end walls, and a top closure means, means forming a generally rectangular coke receiving opening in the top closure means, said side walls being longer than said end walls and extending transverse to the position of a plurality of coke ovens when the car is positioned to receive coke pushed from the ovens, said coke receiving opening being located centrally between said end walls and extending transversely of the receptacle from a point adjacent the side wall thereof closest to an oven during the pushing operation, coke distributing means mounted in said receptacle beneath said coke receiving opening, said coke distributing means having upwardly directed deflector surface means including an apex extending in the general direction of pushing coke from an oven and located centrally within the receptacle beneath said opening to engage and divide coke falling from the coke guide through said coke receiving opening and to impart thereto a horizontal component of motion in a general direction toward said end walls to substantially evenly distribute the coke throughout said receptacle with said transfer car remaining stationary throughout the entire pushing operation.

said coke receiving opening being adapted to receive coke quenching means therethrough to permit coke contained in the receptacle to be quenched therein at a quenching station.

2. The combination as defined in claim 1 further comprising means pivotally mounting said receptacle on a rail car for movement about a horizontal axis below and generally parallel to said one of said side walls, door means formed in one of said side walls adjacent said bottom wall and adapted to be moved between and open position permitting discharge of coke from said receptacle and a closed position, and power means for rotating said receptacle about said axis to incline the floor of the receptacle toward the door to facilitate discharge of quenched coke therefrom.

3. The combination as defined in claim 2 wherein said bottom wall is slightly inclined toward said door in said side wall to normally permit drainage of water from the car, said bottom wall being inclined insufficiently to discharge the coke from said door until said receptacle is rotated about said horizontal axis.

4. The combination as defined in claim 3 wherein said coke distribution means comprises a pair of elongated plates located within the receptacle below the coke entry opening in the top thereof, and means joining adjacent edges of the plates along a common line symmetrically positioned relative to the coke entry opening and contained in a vertical plane extending generally perpendicular to said side walls, the plates being inclined downwardly from the common line in opposite directions toward the respective facing end walls of the receptacle.

5. The combination as defined in claim 4 wherein said elongated plates are joined to one side wall of the rceptacle and are inclined downwardly therefrom in the direction of the opposite side wall.

6. In combination with a coking installation, including a horizontally arranged battery of coke ovens and a coke guide mounted on a guide car for movement along a path in front of the battery and into a pushing position in alignment with the respective coke ovens in the battery, the coke guide having side walls spaced apart a distance slightly greater than the width of the cake of coke pushed from the ovens and having an entry end adjacent to the oven and a discharge end remote from the oven and from which coke is discharged in a direction generally corresponding to the direction of coke pushing, and a coke quenching station remote from the battery of ovens and including coke quenching means and gas cleaning equipment for removal of pollutants released during the quenching operation, an improved pollutant collection and removal system comprising, a generally rectangular receptacle for receiving and containing coke, said receptacle having a flat, generally horizontal bottom, a pair of opposed side walls extending generally perpendicular to the direction of pushing, a pair of opposed end walls extending generally parallel to the direction of pushing, and a top closure means including means providing a coke entry opening therein, said receptacle being of a sufficient size to receive a full charge of coke pushed from one of said ovens with the coke in the receptacle being at a depth to permit wet quenching in the receptacle, coke distribution means mounted within said receptacle beneath said coke entry opening and acting on coke discharged from said coke guide through said coke entry opening to substantially uniformly distribute the total coke pushed from an oven into the receptacle over said receptacle bottom while said receptacle remains in a stationary position in alignment with said coke guide, said coke distributing means having upwardly-directed deflector surface means including an apex extending in the general direction of pushing of coke from the oven and located centrally within the receptacle in position to engage and divide coke falling through the coke entry opening and to impart thereto a horizontal component of motion in a general direction toward the end walls to substantially evenly distribute the coke throughout the receptacle, a rail car supporting said receptacle for movement between said quenching station and a loading position in alignment with the said coke guide with said coke entry opening being positioned below said discharge end of the coke guide when the coke guide is in the pushing position, said coke entry opening having an area and shape to permit ingress of coke pushed from an oven through the coke guide, the coke quenching means at the quenching station being adapted to introduce water into the receptacle through said coke entry opening to permit quenching the coke while in the receptacle, hood means carried by said guide car and substantially enclosing the coke guide, said hood means encompassing said coke entry opening and forming an effective seal with said top closure means when the receptacle is in the loading position, an exhaust manifold on said receptacle, suction means adapted to be connected to said exhaust manifold and operable to create a suction within said receptacle and said hood means to produce a flow of air therethrough and through the open coke oven during the complete pushing operation, means supporting said suction means for movement with said receptacle, and a gas cleaning means operably connected to said suction means for removing pollutants from the flow of air induced by operation of said suction means.

7. The combination defined in claim 6 wherein said hood comprises a means of forming an effective seal between said hood means and the coke discharge end of the respective coke ovens when said coke guide is positioned in alignment therewith to thereby assure a flow of air through the coke oven throughout the pushing operation.

8. The combination defined by claim 6 in which the coke entry opening in the top closure means of the receptacle has a width dimension greater than the space between the side walls of the coke guide and a length dimension greater than its width dimension, the coke entry opening is orientated relative to the direction of movement of the receptacle to position the length dimension of the coke entry opening in the direction corresponding to the direction the coke is pushed, and the coke entry opening includes portions extending outwardly from planes passing through the side walls of the coke guide when the receptacle is positioned with the coke entry opening in alignment with the discharge end of the coke guide.

9. The combination defined by claim 8 in which the coke entry opening in the top closure means of the receptacle is centrally located between said spaced end walls of the receptacle, and the coke entry opening extends along a major portion of the space between said side walls of the receptacle.

10. The combination defined by claim 6 in which the means for substantially uniformly distributing coke over the bottom of the receptacle includes a pair of elongated plates located within the receptacle, and means joining adjacent edges of the plates along a common line symmetrically positioned relative to the coke entry opening, the plates being inclined downwardly from the common line in opposite directions toward respective facing end walls of the receptacle.

11. The combination defined by claim 10 in which the elongated plates are joined to the floor of the receptacle and to one side wall of the receptacle, and the elongated plates being inclined downwardly from said one side wall in a direction toward the other side wall.

12. The combination defined by claim 10 including means for supporting the elongated plates in spaced relation above the floor of the receptacle, the plates having edges lying in substantially horizontal planes, and the elongated plates extending from one wall of the receptacle to an opposite wall of the receptacle at least through a vertical projection of the coke entry opening.

13. The combination as defined by claim 6 wherein said hood means carried by said guide car comprises fixed and movable parts, said fixed part including side walls overlying the side walls of the coke guide and extending beyond the discharge end of the coke guide, and an end closure joining the side walls of the hood and overlying the top of the coke guide and the discharge end of the coke guide, said movable part being pivotally connected in overlying relationship to the fixed part of the hood, said movable part including side walls and an end closure having edges adapted to contact the top closure means about the coke entry opening when the receptacle is in alignment with the coke guide, and means for moving the movable part to bring said edges into and out of contact with the top closure means of the receptacle.

14. The combination defined by claim 13 including means for mounting the receptacle on the rail car for rotation of the receptacle relative to the car about an axis parallel to the direction of movement of the car and adjacent one side wall of the receptacle, means forming a door in the one side wall of the receptacle, the door being adjacent the floor of the receptacle and extending throughout the length of the one side wall, means for mounting the door for swinging movement away from the floor of the receptacle and outwardly of the receptacle, means for rotating the receptacle about the axis to incline the floor of the receptacle downwardly toward the door, and means for swinging the door.

15. The combination as defined by claim 13 including an auxiliary car adapted to be moved with and along the path of movement of the receptacle, said suction means and said gas cleaning equipment operably connected to said suction means being mounted on the auxiliary car, said suction means being in the form of a blower having a suction side and the gas cleaning equipment having an inlet and an outlet, disconnectable connecting means forming communication between the manifold of the receptacle and the inlet to the gas cleaning equipment, and means forming communication between the outlet of the gas cleaning equipment and the suction side of the blower.

16. The combination defined by claim 15 further comprising power means for transporting the rail car with the receptacle containing coke and the auxiliary car to the coke quenching station with the connecting means forming communication between the manifold of the receptacle and the inlet to the gas cleaning equipment, means for moving the coke quenching means to within the receptacle through the coke entry opening and for moving the quenching means to without the receptacle, means for mounting the receptacle for rotation about an axis adjacent a side wall of the receptacle, a movable door in said side wall of the receptacle adjacent the floor of the receptacle, means for rotating the receptacle to incline the floor of the receptacle toward the door, and means for opening the door outwardly of the receptacle.

17. The combination defined by claim 16 in which said generally horizontal floor of the receptacle is inclined in a direction toward the door sufficiently to permit water drainage when the receptacle is in non-inclined position.

18. In a coking installation including a horizontally arranged battery of coke ovens and a coke guide mounted on a guide car for movement along a path in front of the battery and into a pushing position in alignment with the respective coke ovens in the battery, the coke guide having side walls enclosed within a hood and having an entry end adjacent to the oven and a discharge end remote from the oven and from which coke is discharged in a direction generally corresponding to the direction of coke pushing, a coke quenching station remote from the battery of ovens and containing gas cleaning equipment for removal of pollutants released during the quenching operation, a hot coke transfer and quenching car for receiving hot coke pushed from said ovens through said coke guide and transferring the hot coke to the quenching station, and a pollutant collection and removal system for removing pollutants released from the coke into the air during the pushing and transferring operation, the improvement wherein said hot coke transfer car comprises, a generally rectangular receptacle for receiving and containing coke when positioned in alignment with said coke guide in the front of one of said ovens, said receptacle/having a flat, generally horizontal bottom wall, upwardly extending opposed side walls and end walls, and a top closure, said side walls being longer than said end walls and extending in a direction transverse to the direction of movement of coke pushed from said ovens when said receptacle is in position to receive coke from said coke guide, means forming an elongated generally rectangular coke receiving opening in said top closure, said coke receiving opening being located between and a substantially equal distance from said end walls and having side and end edges extending generally parallel to the side and end walls respectively of the receptacle, an exhaust manifold communicating with the interior of said receptacle through said closure and adapted to be connected with exhaust means for withdrawing gases from said receptacle, door means formed in one of said side walls adjacent said bottom wall and adapted to be moved between an open position permitting discharge of coke from said receptacle and a closed position, rail car means supporting said receptacle for movement between said battery of coke ovens and said coke quenching station, pivot means supporting said receptacle on said rail car for pivotal movement about an axis parallel to said side walls, means for pivotally moving said receptacle about said axis, and coke distributing means associated with said opening, said coke distributing means including upwardly directed surface means having an apex located centrally with respect to said coke receiving opening and downwardly extending portions on each side of said apex inclined toward said end walls whereby coke entering the receptacle through said coke receiving opening and contacting said coke distributing means will be divided and a horizontal component of motion imparted thereto towards each said end wall thereby permitting one-spot filling of the receptacle with the coke being substantially evenly distributed throughout the receptacle to permit quenching of the coke in the receptacle at the quenching station.

* * * * *

UNITED STATES PATENT AND TRADEMARK OFFICE

CERTIFICATE OF CORRECTION

PATENT NO. : 4,113,572

DATED : September 12, 1978

INVENTOR(S) : JOHN G. MANDA, D. Burroughs, F. Cairns

It is certified that error appears in the above-identified patent and that said Letters Patent are hereby corrected as shown below:

Column 3, line 11, "communcation" should be -- communication --.

Column 6, line 33, "object" should be -- feature --.

Column 9, line 64, "rectacle 21" should be -- receptacle 21 --.

Column 10, line 45, "remove from " should be -- remote from --.

Column 11, line 68, after "pushed", "uder the" should be -- under the --.

Column 12, line 57, "byu providing" should be -- by providing --.

Column 13, line 6, "the gas" should be -- the car --;

Line 8, after "used." insert -- Accordingly, reference will be had to the appended claims for a definition of the limits of the invention --;

Line 54, "operation." should be -- operation,--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*